US005330320A

United States Patent [19]

Månsson

[11] Patent Number: 5,330,320

[45] Date of Patent: Jul. 19, 1994

[54] METHOD AND A DEVICE IN A ROTATING MACHINE

[75] Inventor: Martin Månsson, Finspong, Sweden

[73] Assignee: ABB Carbon AB, Finspong, Sweden

[21] Appl. No.: 40,619

[22] Filed: Mar. 31, 1993

[30] Foreign Application Priority Data

Apr. 1, 1992 [SE] Sweden ..... 9201061-0

[51] Int. Cl.[5] ..... F01D 25/24

[52] U.S. Cl. ..... 415/129; 415/131

[58] Field of Search ..... 415/126, 127, 129, 131; 60/39.31, 39.32

[56] References Cited

U.S. PATENT DOCUMENTS

| | | | |
|---|---|---|---|
| 1,823,310 | 9/1931 | Allen | 415/131 |
| 2,762,559 | 9/1956 | Faught | 60/39.32 |
| 3,227,418 | 1/1966 | West | 415/127 |
| 4,149,826 | 4/1979 | Torstenfelt | 415/127 |
| 4,332,523 | 6/1982 | Smith | 415/126 |
| 5,051,061 | 9/1991 | Meylan | 415/126 |
| 5,203,673 | 4/1993 | Evans | 415/126 |

*Primary Examiner*—John T. Kwon

*Attorney, Agent, or Firm*—Pollock, Vande Sande & Priddy

[57] ABSTRACT

A method and a device for controlling the blade tip clearance in a rotating machine where the machine comprises a turbine part and a compressor part separate from the turbine part and the stator housing of the turbine part is formed with a stator cone. The invention is characterized in that one or more bladed turbine discs during a non-steady operation, such as start-up, stop and load changes, are moved out of the stator cone whereby the blade tip clearance is increased and that the turbine discs during continuous operation are moved into the stator cone such that the blade top clearance is reduced.

10 Claims, 2 Drawing Sheets

METHOD AND A DEVICE IN A ROTATING MACHINE

TECHNICAL FIELD

The invention relates to a rotating machine comprising a turbine part with at least one turbine disc attached to a rotor shaft where the outer part of the turbine disc in the form of a blade ring cooperates with a stator housing and where the turbine disc is connected via the rotor shaft to the rotor shaft of a compressor part.

BACKGROUND OF THE INVENTION

It is very important for the efficiency and performance of the turbine part that the distance defining the clearance between the blade tips of the turbine disc and the stator housing of the turbine part, is as small as possible. This applies particularly to the continuous operating state in which the turbine is intended to be run. During start-up and load changes, the requirement for efficiency can be lowered.

The elements comprised by the turbine part, for example rotor shaft blades and stator housing, are heated and cooled differently rapidly during non-steady states, for example during start-up and load increases and during stop and load reductions. This is due to the fact that the elements have different mass and that they are influenced to a varying extent by the hot gas flow which passes through the turbine part. The heating of the elements results in linear expansion and deformations, which means that clearances between rotating and static elements during non-steady states are influenced.

During the non-steady states, the blade tip clearance is reduced and can be completely eliminated if, in cold or in heated condition, it is chosen too small. This leads to contact and seizure, which is unacceptable. To avoid contact between rotating and static parts, a clearance between the blade tips and the turbine housing is chosen which is sufficiently large to prevent blade tip contact during start, stop and load changes and which is sufficiently small during continuous operation to prevent an unacceptably low efficiency.

The clearance between the blade tips and the stator housing must thus be chosen on the basis of the operating state which gives the smallest permissible clearance taking into account the uneven temperature distribution, the extension of the blades because of the centrifugal force, and the like.

One way of reducing the blade tip clearance during continuous operation is to design the turbine such that expansion and deformation because of the temperature can be controlled by distributing the mass in the turbine such that movements and deformations are overcome or redistributed.

Another way is to introduce operating restrictions to avoid the most difficult operating states which are determining for the clearance between the blade tips and the stator housing.

Thus, the problem is to dimension the clearance between the blade tips and the stator housing so as to obtain the best possible performance and efficiency without the risk of blade tip contact with the stator housing arising, especially during start-up, stop and load changes, and without the clearance becoming unnecessarily large.

SUMMARY OF THE INVENTION

The invention aims to provide a method and a device for controlling the blade tip clearance, that is, control of the clearance between the blade tips of a turbine and a turbine stator housing in a rotating machine. The control is performed such that the clearance during start-up, stop and load changes is larger than during continuous operation to obtain better performance and a higher efficiency without the risk of blade tip contact during start-up, stop and load changes.

The machine according to the present invention comprises a turbine part and a compressor part, the turbine part comprising a stator housing, a rotor shaft which is rotatably journalled in the stator housing and which has at least one turbine disc with blades, the rotor shaft being secured to a rotor shaft comprised by the compressor part so as to obtain a common rotor shaft. The common rotor shaft is axially journalled in the compressor part.

At their outer parts the turbine discs are provided with blades, which at their outer parts are angled at an angle coinciding with the cone angle of the stator housing. The conical part of the stator housing will be referred to in the following as the stator cone.

The present invention comprises a method and a device for moving the turbine disc/turbine discs out of the stator cone during start-up, stop and load changes, such that the clearance between the blade tips and the stator housing is increased. This clearance will be referred to in the following as the blade tip clearance.

Due to the angularity of the blade tips and of the stator cone, the clearance between the blades and the stator housing may be influenced when the rotor shaft is axially displaced. To bring about this axial displacement between the rotor shaft and the stator housing, the following solution can be used.

The compressor part is mounted such that it can be displaced in the axial direction whereas the turbine housing is secured to a base. The axial displacement of the turbine discs with the blades is brought about by displacing the compressor part in the axial direction whereby the axial fixing of the interconnected rotors in the compressor part results in the turbine disc with the blades being displaced in the same axial direction as the compressor part.

In case of a load increase, for example, the compressor part is displaced in the axial direction whereby also the rotor shaft is displaced axially such that the blade tip clearance is increased. When the machine has become thoroughly hot, the compressor part is displaced such that a minimum blade tip clearance is obtained. In case of renewed load change, the blade tip clearance is again enlarged, and during subsequent continuous operation it is again set at the minimum clearance.

The advantage of the invention is thus that the blade tip clearance can be controlled in a simple manner during operation, thus solving the problem with too large and too small clearances.

DESCRIPTION OF THE PREFERRED EMBODIMENTS

Figure 1:
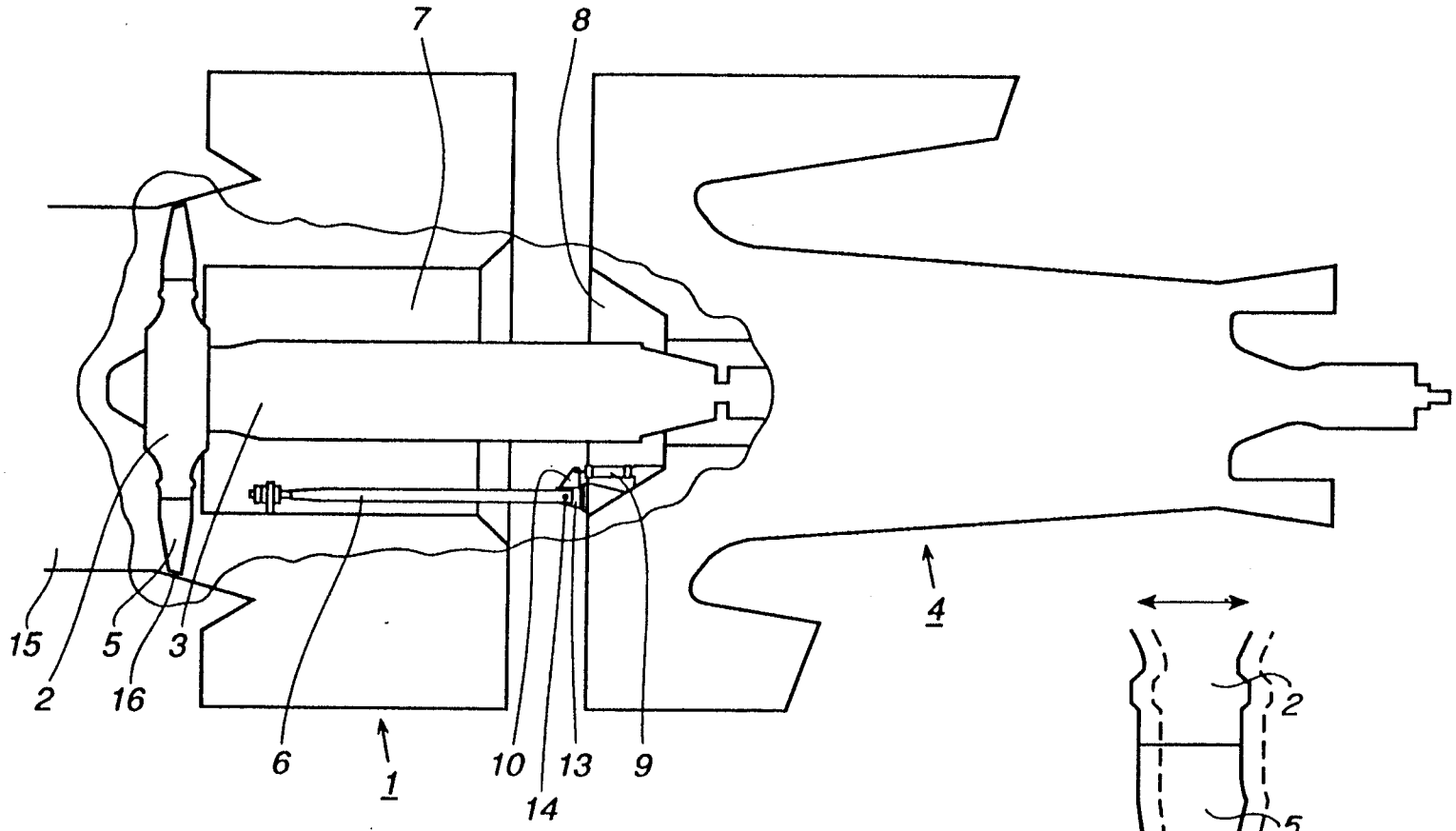
FIG. 1 schematically shows a partial axial section through a turbine part and a compressor part to which the invention is applied.

FIG. 1 shows a rotating machine with a turbine part 1 in which a turbine disc 2 is arranged. The turbine disc 2 is secured, via a rotor shaft, to the rotor shaft of a compressor part 4 which is separate from the turbine part, the latter rotor shaft forming a common rotor shaft 3 which is axially journalled in the compressor part 4. At its outer part the turbine disc 2 is provided with blades 5. The compressor part 4 is pendantly supported (not shown) at its front and rear ends enabling it to be pushed in the axial direction. The machine is divided between the outlet housing 7 of the turbine part 1 and the inlet housing 8 of the compressor part 4.

One or more, preferably two diametrically placed, axial rods 6 are adapted to interconnect the compressor part 4 and the turbine part 1. The rods 6 are attached in the outlet housing 7 and in the inlet housing 8.

Figure 2A:
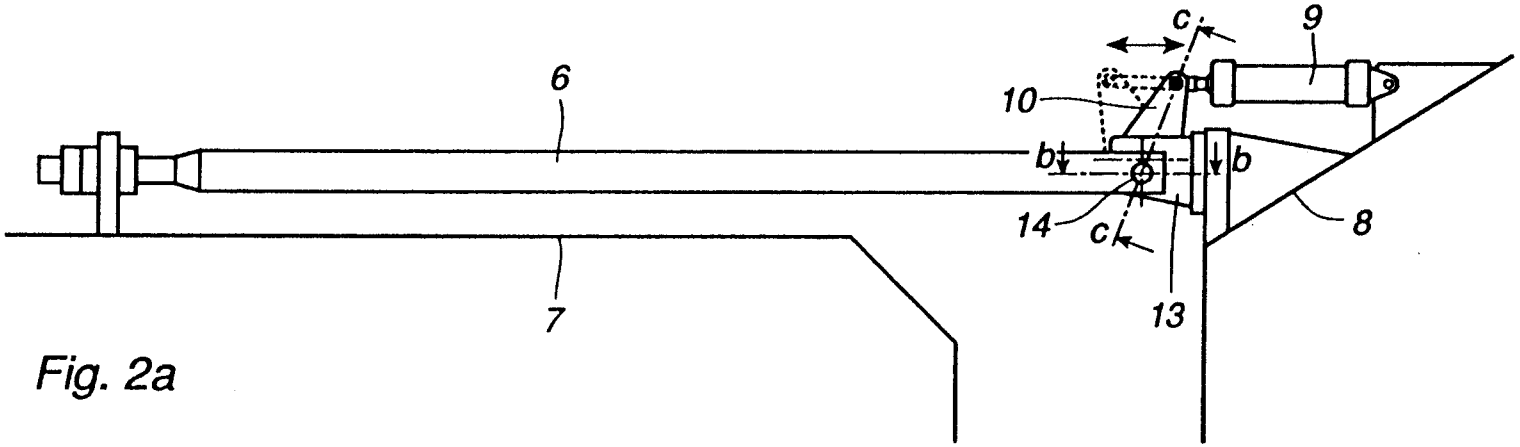
FIG. 2*a* schematically shows various views of a device for moving the compressor part towards and away from the turbine part.
Figure 2D:
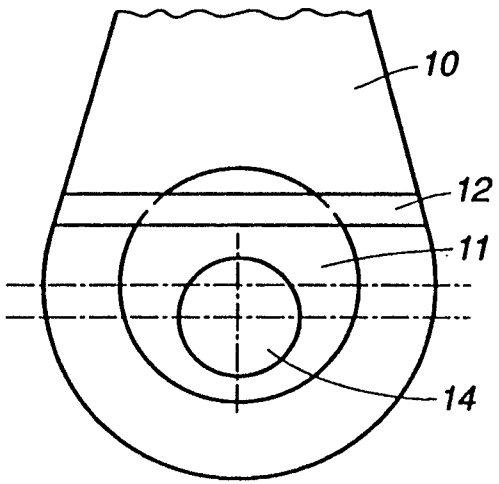
FIG. 2*d* shows a section d—d according to FIG. 2*c.*
Figure 2C:
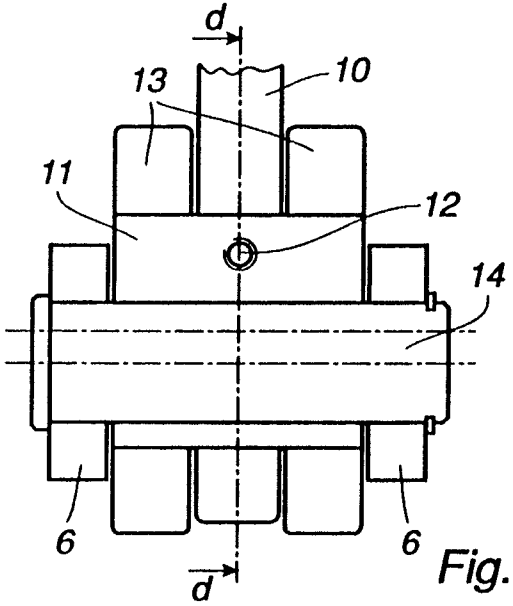
FIG. 2*c* shows a section according to c—c in FIG. 2*a;*
Figure 2B:
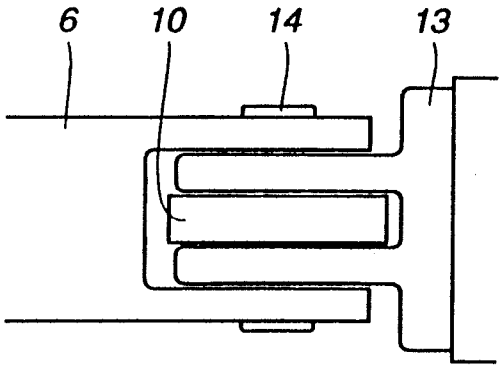
FIG. 2*b* shows a section according to b—b in FIG. 2*a;*

FIG. 2*a* shows an example of how a device for moving the compressor part 4 in the axial direction away from and towards the turbine part 1 can be designed.

At the inlet housing 8 of the compressor part 4, a piston 9 of a conventional type is arranged. The piston is adapted to influence a control arm 10. The control arm 10 is fixed to an eccentric bolt 11 by means of a pin 12. The eccentric bolt 11 in its turn is rotatably attached to a bracket 13 fixed to the inlet housing 8. Via a cylindrical shaft 14, the rod 6 is journalled in the eccentric bolt. The shaft 14 has its center of rotation displaced in relation to the center of rotation of the eccentric bolt 11.

When the piston 9 is shortened, the control arm 10 is rotated around the center of the shaft 14. During the rotating movement, the eccentric bolt 11 is moved from the center of the shaft 14 because of the eccentricity of the eccentric bolt. Since the control arm 10 via the rod 6, which is also journalled around the shaft 14, is fixedly journalled in the outlet housing 7 of the turbine part 1 whereas the bracket 13 is fixed to the axially displaceable compressor part 4, the compressor part 4 is pushed in an axial direction away from the turbine part 1.

Figure 3:
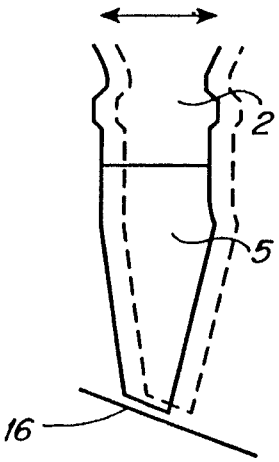
FIG. 3 shows in an axial section the clearance between a stator cone and a blade tip.

FIG. 1 also shows how the stator housing 15 of the turbine part 1, at that part which surrounds the turbine disc 2, is conically shaped with its largest cone diameter facing the outlet housing 7. This conical part of the stator housing 15 is referred to as the stator cone 16. The tip angle of the blades 5 substantially corresponds to the cone angle of the stator housing 15. When the turbine disc 2 is caused to be moved in a direction towards the outlet housing 7 of the turbine part 1, the clearance between the tips of the guide vanes 5 and the stator cone 16 will increase (see FIG. 3). With the turbine disc 2 in this position, it is suitable to start and stop the machine and to carry out load changes.

When the machine has become heated after a start or after a load increase, the piston 9 is caused to be extended whereby the compressor part 4 with the rotor shaft 3 and the turbine disc 2 is moved towards the interior of the stator cone 16 and the clearance is reduced.

The operation of the piston 9, for control of the blade tip clearance, can be performed either manually or automatically. Extension of the piston 9 may, for example, take place after a certain period of time after a start or when a certain power has been attained. Shortening of the piston 9 may, for example, take place in connection with a stop impulse being given to the machine.

It is, of course, possible also to utilize the invention in turbines 1 with more than one turbine stage. The stator housing 15 is then conically shaped in the entire area around the turbine discs 2, that is, from the first to the last turbine stage.

In the above embodiment a machine which is divided between the turbine part 1 and the compressor part 4 has been described.

However, the invention is also applicable to machines with an integrated turbine and compressor part 1, 4, where the rotor shaft 3 is journalled outside the turbine 1 and the compressor 4. The invention is, of course, also applicable to machines with the stator cone 16 facing in the other direction as compared with the embodiment described.

I claim:

1. A device for controlling the blade tip clearance in a rotating machine, which machine includes a turbine part and a compressor part, the turbine part including a stator housing, a rotor shaft, rotatably journalled in the stator housing, with at least one turbine disc with blades fixedly arranged on said rotor shaft, the rotor shaft being secured to a rotor shaft comprised by the compressor part such that a common rotor shaft is obtained, the stator housing being formed with a stator cone, wherein the blade tips have an angle which substantially corresponds to the angle of the stator cone, wherein the rotor shaft and the stator housing are displaceable in relation to each other, wherein the rotor shaft is axially journalled in the compressor housing and wherein the compressor part is pendantly suspended so as to permit displacement thereof, including the rotor shaft and the turbine disc/turbine discs, in the axial direction.

2. A device according to claim 1, wherein at least one axial rod is adapted to interconnect the turbine part and the compressor part.

3. A device according to claim 1 wherein a piston is adapted to displace, in the axial direction, the compressor part towards and away from the turbine part.

4. A device according to claim 1, wherein a control arm, via a pin, is fixed to an eccentric bolt which is rotatably attached to a bracket and wherein the control arm, the eccentric bolt, the bracket and the rod are journalled around a shaft.

5. A device according to claim 3 wherein the piston is adapted, via the eccentric bolt, to cause the bracket to displace the compressor housing in the axial direction via the rod.

6. A device according to claim 2, wherein a piston is adapted to displace, in the axial direction, the compressor part towards and away from the turbine part.

7. A device according to claim 3, wherein a control arm, via a pin, is fixed to an eccentric bolt which is rotatably attached to a bracket and wherein the control arm, the eccentric bolt, the bracket and the rod are journalled around a shaft.

8. A device according to claim 4, wherein the piston is adapted, via the eccentric bolt, to cause the bracket to displace the compressor housing in the axial direction via the rod.

9. A method for controlling the blade tip clearance in a rotating machine, machine including a turbine part and a compressor part, the turbine part including a stator housing, a rotor shaft, rotatably journalled in the stator housing, with at least one turbine disc with blades fixedly arranged on said rotor shaft, the rotor shaft being secured to a rotor shaft comprised by the compressor part such that a common rotor shaft is obtained, the stator housing being formed with a stator cone, the blade tips having an angle which substantially corresponds to the angle of the stator cone, and wherein the rotor shaft and the stator housing are displaceable in relation to each other, said method comprising the steps of:

axially journalling the rotor shaft in the compressor part and axially displacing the compressor part, including the rotor shaft and the turbine disc/turbine discs, in relation to the stator housing.

10. A method according to claim 9, wherein the compressor part in case of load changes is displaced axially such that the blades are moved out of the stator cone and the blade tip clearance is increased, and wherein the compressor part during continuous operation is displaced axially so that the turbine disc is moved into the stator cone and the blade tip clearance is reduced.

* * * * *